US005390515A

United States Patent [19]

Essick

[11] Patent Number: 5,390,515

[45] Date of Patent: Feb. 21, 1995

[54] SECURITY CONTAINER AND RELEASE KEY THEREFOR

[75] Inventor: Gale W. Essick, E. Canton, Ohio

[73] Assignee: Alpha Enterprises, Inc., North Canton, Ohio

[21] Appl. No.: 8,632

[22] Filed: Jan. 25, 1993

[51] Int. Cl.[6] ..... B65D 55/14

[52] U.S. Cl. ..... 70/63; 70/57.1; 70/14; 70/401; 70/387; 206/1.5; 16/114 R

[58] Field of Search ..... 206/1.5; 70/63, 387, 70/389, 399, 401, 405, 408, 14, 58, 57, 57.1, 429, 162, 345, 394; 16/114 R; 294/15

[56] References Cited

U.S. PATENT DOCUMENTS

| | | | |
|---|---|---|---|
| 2,014,112 | 9/1935 | McCord | 16/114 R |
| 2,893,777 | 7/1959 | O'Neill et al. | 294/15 |
| 3,125,873 | 3/1964 | Robinson | 70/63 |
| 3,828,922 | 8/1974 | Holkestad | 70/63 |
| 4,084,690 | 4/1978 | Pulse | 206/310 |
| 4,109,379 | 8/1978 | Ratti et al. | 294/15 |
| 4,627,534 | 12/1986 | Komiyama et al. | 206/387 |
| 4,702,369 | 10/1987 | Philosophe | 206/312 |
| 4,718,547 | 1/1988 | MacTavish | 206/309 |
| 4,805,769 | 2/1989 | Soltis et al. | 206/309 |
| 4,871,065 | 10/1989 | Hehn et al. | 206/387 |
| 4,903,829 | 2/1990 | Clemens | 206/310 |
| 5,079,935 | 1/1992 | Zaucha | 70/162 |
| 5,129,244 | 7/1992 | Wittman | 70/57.1 |
| 5,255,543 | 10/1993 | Wittman | 70/57.1 |

*Primary Examiner*—Peter M. Cuomo
*Assistant Examiner*—Darnell M. Boucher
*Attorney, Agent, or Firm*—Michael Sand Co.

[57] ABSTRACT

A recording medium security container and associated release key which disengages a lock mechanism of the security container enabling the security container to be moved to an open position for removing the contents thereof. The security container has a base, a lid pivotally mounted on the base, and a lock mechanism for securing the lid in a locked position on the base. The key has a grasp base and a plurality of tabs extending outwardly from the base for disengaging the lock mechanism of the security container. Also provided on the key is a pivotally mounted lever which has a pair of tangs which releasably engage and grip the base of the security container so that the key may be grasped to pull the base away from the lid to an open position, while the tabs extending from the key disengage the lock mechanism of the security container.

18 Claims, 8 Drawing Sheets

FIG-3
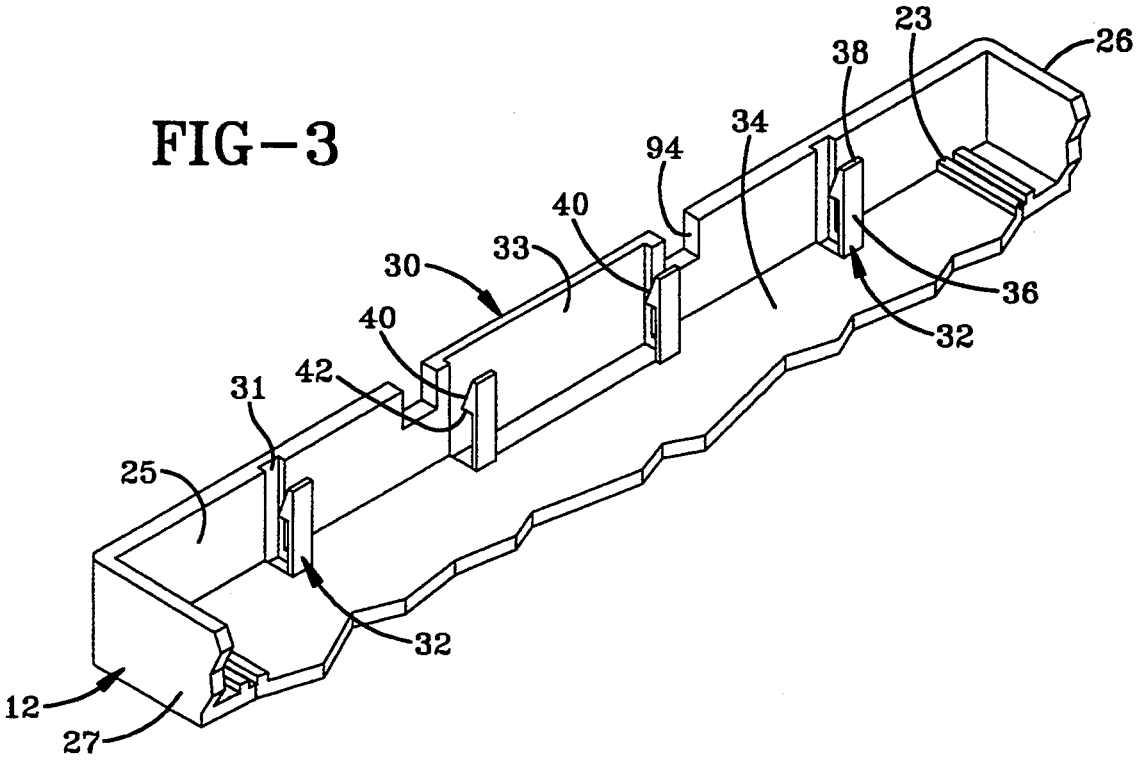
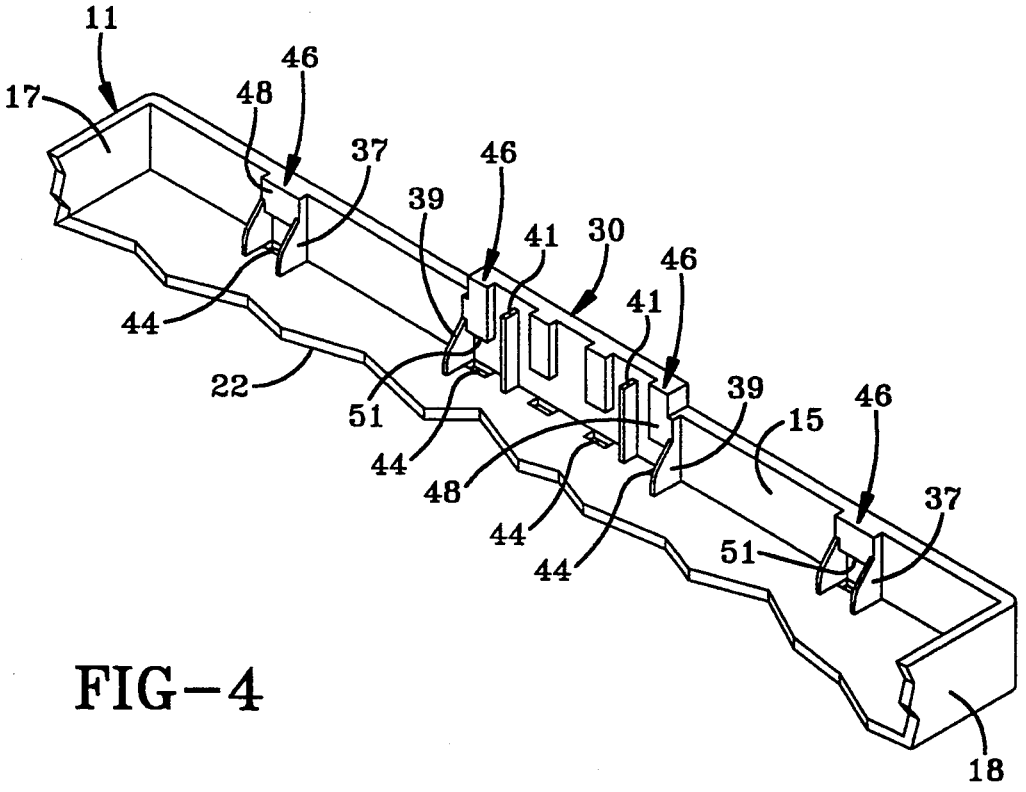
FIG-4

SECURITY CONTAINER AND RELEASE KEY THEREFOR

BACKGROUND OF THE APPLICATION

1. Technical Field

The invention relates generally to security containers of the type for holding a package containing an audiocassette, videocassette or compact disc and a related release key. More particularly, the invention relates to such a security container and related release key which enables the security container to be opened more easily than heretofore possible. Specifically, the invention relates to a hand-held release key which remains attached to the security container to assist in opening the security container.

2. Background Information

Audiocassettes, videocassettes, and compact discs (CDs) have become increasingly popular over the past several years and have become an important segment of the recording and movie industry. These three general types of recording media are displayed in retail stores for sale and/or rental in a variety of display packages. Audiocassettes are predominantly sold and displayed in a two-piece plastic case such as shown in U.S. Pat. No. 4,627,534. These plastic display boxes are usually wrapped in a clear cellophane outer wrapping to protect the cassette from contaminants and prevent their removal from the outer protective plastic package or box.

Likewise, CD's are most commonly stored in a container referred to as a "jewel box" somewhat similar to the type of package in U.S. Pat. Nos. 4,084,690, 4,702,369 and 4,903,829, wherein the disc is contained within a hinged lid plastic package.

It is important, especially in the audiocassette market, and the CD market discussed above, that the plastic packages or boxes in which the items are contained, be repackaged in an outer security package to prevent their theft from the display cases used in most retail businesses. Various types of display and security packages have been developed for audiocassettes such as shown in U.S. Pat. Nos. 4,759,442, 4,381,836, 3,871,516, 4,881,645, 4,834,238, 4,285,429 and 4,589,549. Likewise, due to the increased cost of CDs, security devices also have been developed for displaying them, such as shown in U.S. Pat. Nos. 4,718,547, 4,805,769 and 4,871,065.

Although these security containers for the various types of cassettes and CD's have proven satisfactory for many applications, they do present one major problem, that is, many such containers of which applicant is aware, are opened by inserting a hand-held key into the security container, with the container then being pulled apart to release the enclosed cassette or CD. The process thus far has been unwieldy. The plastic key when inserted to disengage the lock remains inserted in the container while the user releases the key, grasps one part of the container in each hand, and pulls it apart. As such, the user is not grasping the key while the container is being opened which may cause the key to not fully engage the lock, or to fall out of the security container altogether. An example of one such container is in the recently allowed U.S. application owned by Alpha Enterprises, Inc., Ser. No. 07/721,113, now U.S. Pat. No. 5,205,406, whose contents are incorporated herein by reference.

A second problem which is presented by some of the prior art security containers and respective keys, is that different keys are needed to open the CD security containers than the audio and video cassette security containers. Employing separate keys not only requires the retail stores and the manufacturers to stock two types of keys, but the sales clerk must continually alternate keys depending on whether a CD or cassette is the subject of the sale. Alternating keys not only waste time, but adds to the confusion at the point of sale.

Therefore, the need exists for an improved security container for various types of cassettes and CDs in which the cassettes or CDs are preferably maintained in their usual display packages, but when placed in a security container, are able to be displayed in display racks heretofore used for the unsecured package, and which allow the sales clerk to open the security container while simultaneously maintaining a firm grasp upon the security container release key. Moreover, the need exists for a security container key which may be used to open both a security container with an enclosed CD as well as a security container with an enclosed audio or videocassette.

SUMMARY OF THE INVENTION

Objectives of the invention include providing an improved security container wherein the contents thereof preferably are of the audio, video or CD recording medium, which container enables the cassette or CD to remain in its usual display and storage package, which in turn is secured within a container which retards theft of the cassette or CD and its display package.

Another objective of the invention is to provide such an improved security container which is provided with locking means whereby a closure lid of the container is secured in a locked position; in which the lid can be easily opened by use of a specially designed release key, thereby preventing or reducing the unauthorized removal of the cassette or CD from within the security container; and in which the locked lid enables the security container to be reused after the package and cassette or CD is removed from the container by authorized personnel.

A further objective of the invention is to provide a security container which may be opened while the user is still grasping the release key thus allowing the key to be held securely in communication with the security container locking mechanism during the unlocking process.

A still further objective of the invention is to provide a release key which will firmly grasp a portion of the security container whereby the key is used as a handle to assist in opening the security container.

Yet another objective of the invention is to provide a release key which is spring biased to remain in a gripping engagement with the security container, which spring bias may be easily overcome to release the key after the security container is opened.

Still another objective of the invention is to provide a release key which may be employed to open both the security container with an enclosed CD as well as a security container with an enclosed audio or videocassette.

A further objective of the invention is to provide such a container which is of a relatively simple construction, yet which achieves the stated objectives in a simple, effective and inexpensive manner, and which solves problems and satisfies needs in the art.

These and other objectives and advantages are obtained by a key for unlocking a lock mechanism of a security container, which container holds an article, the general nature of which may be stated as including a key having a housing; tab means extending outwardly from said housing for operatively engaging and unlocking a lock mechanism of a security container; and gripper means for releasably gripping and moving a closure lid of a security container from a closed locked position toward an open position.

These objectives and advantages are further obtained by the combination of a security container having a base forming a storage compartment, a lid mounted on the base and movable between open and closed position with respect to said base, and locking means for locking said base to said lid when in the closed position; and a key for unlocking the lid from the base to enable the lid to be moved toward the open position; said key having tab means for operatively engaging and unlocking the lock means of the security container, and gripper means for releasably gripping the base while the lid is being moved toward the open position.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

FIG. 3 is a fragmentary perspective view of the locking fingers formed on the lid of the security container of FIGS. 1 and 2;

FIG. 4 is a fragmentary perspective view of the locking projections formed on an end wall of the base of the security container;

Similar numerals refer to similar parts throughout the drawings.

DESCRIPTION OF THE PREFERRED EMBODIMENT

Figure 1:
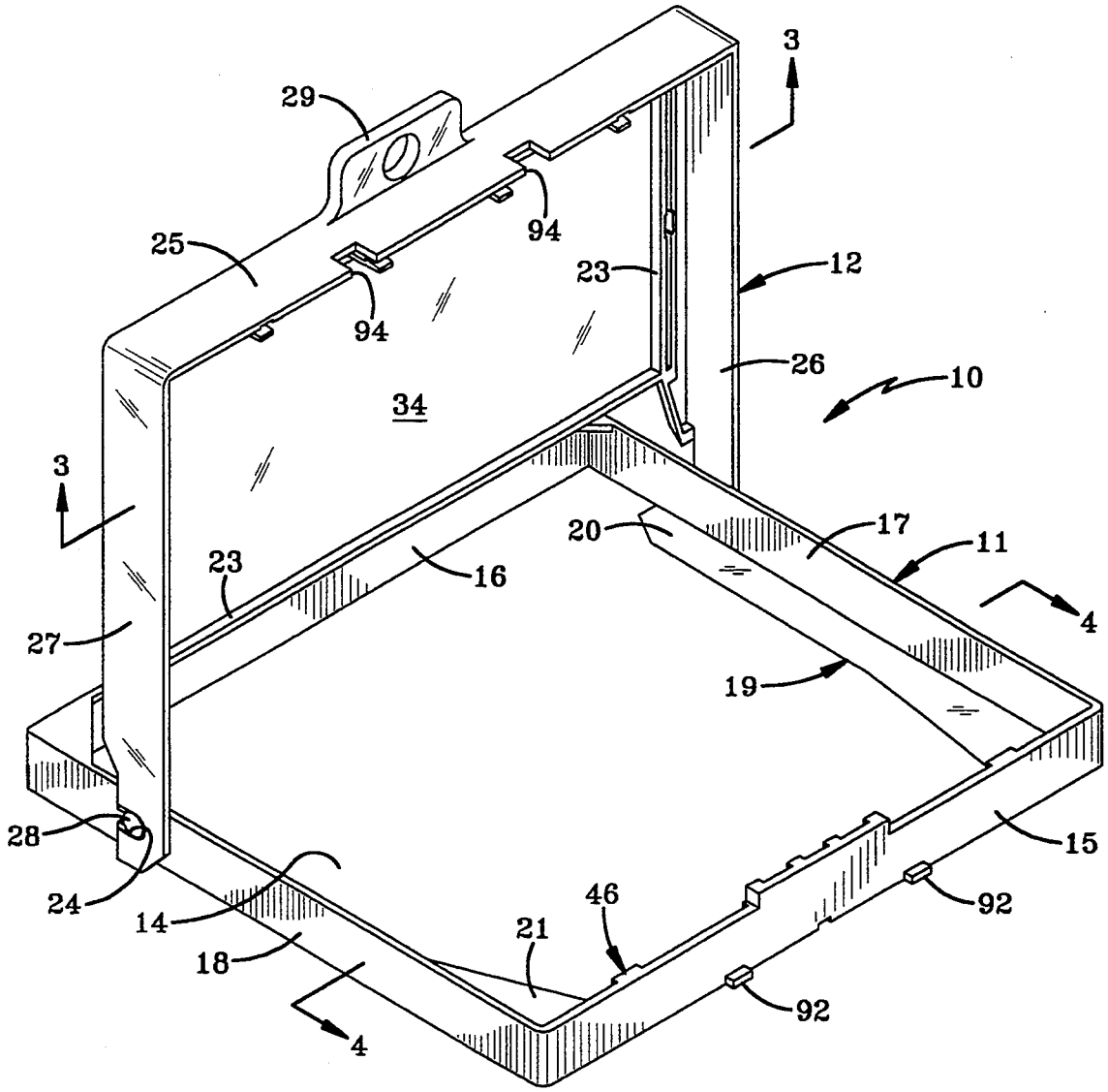
FIG. 1 is a perspective view of the improved security container for storing a CD with the lid being shown in open position.
Figure 13:
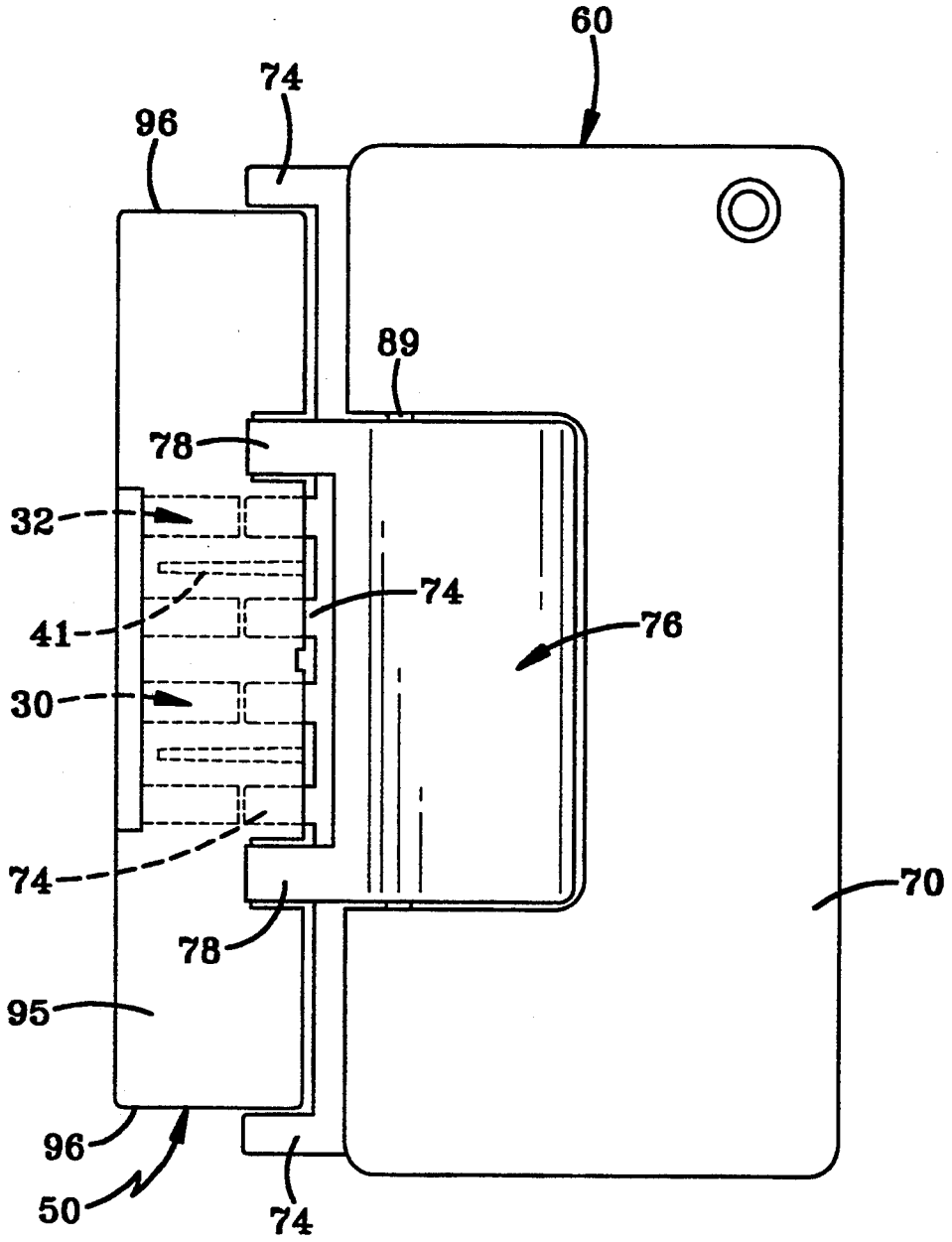
FIG. 13 is an end elevational view showing the release key of the present invention engaged with the end wall and locking mechanism of an audiocassette security container.

One embodiment of the improved security container is indicated generally at 10, and is shown particularly in FIG. 1. Container 10 is of the type which is used for CDs. A second embodiment is shown in FIG. 13 and is indicated generally at 50, and is used for storing audiocassettes. The main difference between the two embodiments being the overall dimensions thereof. When used for an audiocassette, container 50 will contain the usual plastic storage package or case such as shown in U.S. Pat. No. 4,627,534. When used with a usual CD, container 10 will house a usual plastic package or case referred to in the industry as a "jewel box" indicated at 13 in FIGS. 5 and 6, with the CD enclosed therein. Container 10 is of the general type shown in U.S. patent application, Ser. No. 07/721,113, now U.S. Pat. No. 5,205,401, which is owned by Alpha Enterprises, Inc., assignee of the present application, with slight alterations thereto.

Container 10 includes two main components, a base and lid indicated generally at 11 and 12, respectively. Base 11 has a rectangular configuration and forms an integral storage compartment 14 formed by parallel spaced first and second end walls 15 and 16, a pair of spaced parallel side walls 17 and 18, and a bottom wall, indicated generally at 19.

Figure 2:
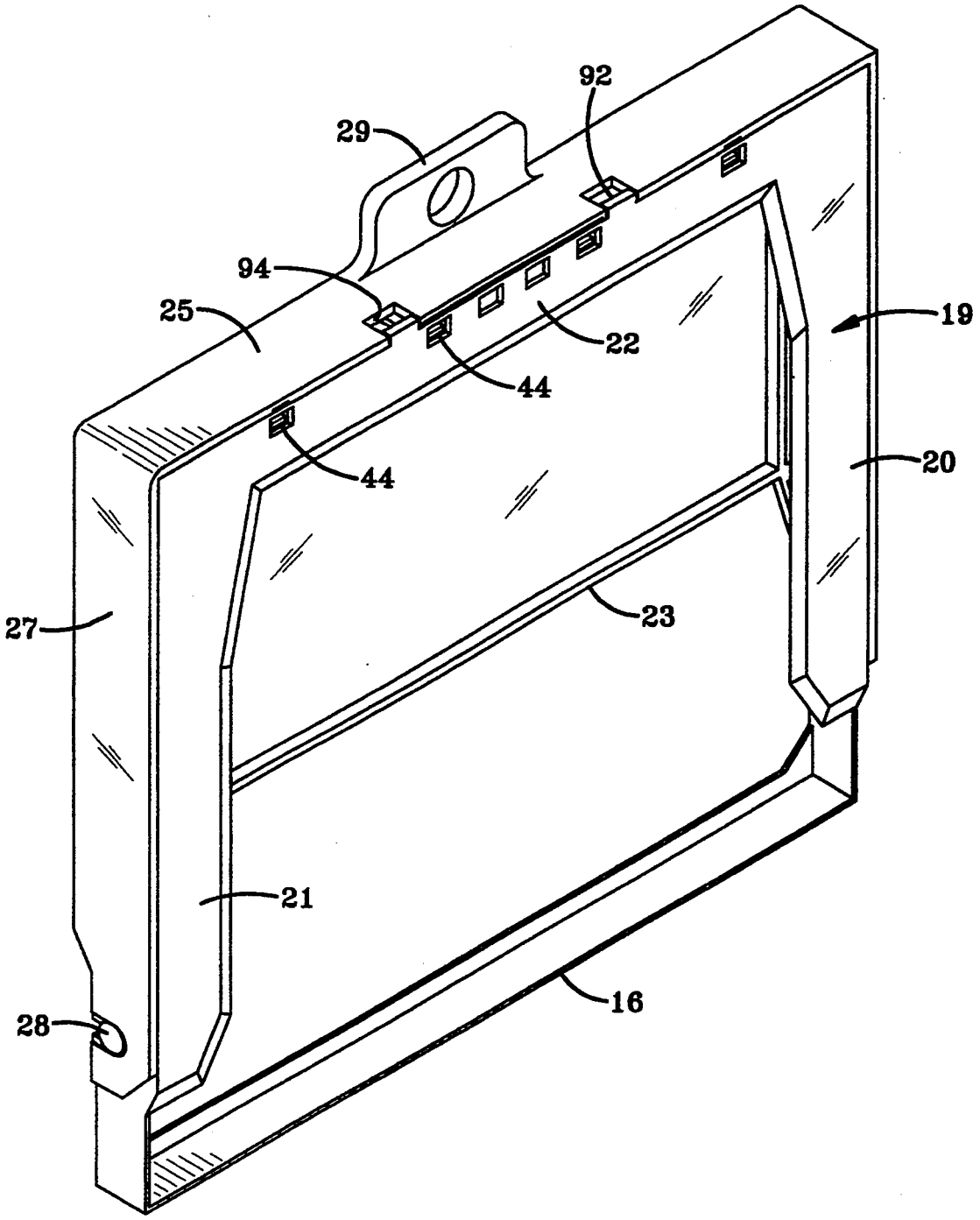
FIG. 2 is a perspective view of the security container of FIG. 1 in closed locked position.

Bottom wall 19 as shown particularly in FIGS. 1 and 2, has a generally U-shaped configuration formed by spaced parallel ledges 20 and 21 which extend along and are formed integrally with the bottom edges of side walls 17 and 18, respectively. A third ledge 22 (FIG. 2) is formed integrally with first end wall 15 and extends along the bottom edge thereof. Thus, ledge 22 in combination with ledges 20 and 21, form U-shaped bottom wall 19.

Lid 12 has a U-shaped configuration formed by end wall 25 and spaced parallel sidewalls 26 and 27. A top wall 34 extends the entire length of end wall 25 and partially between sidewalls 26 and 27. Pairs of reinforcing ribs 23 are formed on the inside surface of lid wall 34 to increase the rigidity thereof and to provide intervening channels for receiving one or more electronic article surveillance (EAS) members (not shown) if desired by the retailer.

A pair of key-hole shaped slots 24 are formed in the outer ends of side walls 26 and 27 of lid 12, into which are snap-fitted a pair of pivot posts 28 which are formed integrally with and extend perpendicularly outwardly from base side walls 17 and 18. Pivot posts 28 have outer disc-shaped ends which trap lid walls 26 and 27 on the pivot post. This arrangement enables base 11 and lid 12 to be separately molded and then lid 12 merely snap-fitted into position on base 11 by engagement of pivot post 28 within key-shaped slots 24. This enables the two components which are of a relatively simple generally rectangular-shaped design, to be easily molded in less complicated and less expensive dies than more complicated single piece types of containers having irregular shapes. A hanger 29 may be formed integrally on end wall 25 for displaying container 10 on certain types of display racks.

In accordance with the invention, an improved locking mechanism indicated generally at 30, shown particularly in FIGS. 3–6, is formed in combination on base end wall 15 and lid top wall 34, for releasably securing lid 11 in a closed locked position, as shown particularly in FIG. 2. Referring to FIGS. 3 and 4, there is shown in cutaway, the portion of base 11 and lid 12 which include locking mechanism 30. Lid 12 includes a plurality of flexible locking fingers 32, four of which are shown, which extend outwardly from top wall 34 in a direction substantially parallel to end wall 25 and spaced a short distance therefrom. Fingers 32 (FIG. 3) each include a stem 36 which terminates at a tip 38. An outwardly extending camming surface 40 extends from tip 38 which joins stem 36 at a right angled shoulder 42. Camming surfaces 40 preferably face end wall 25 of lid 12 for purposes which will be described in more detail hereinbelow. The two end fingers 32 align with die molding slots 31 formed in the inside surface of end wall 25, with the two inner fingers 23 aligning with the ends of a single large die molding recess 33 formed in the center of wall 25.

Figure 5:
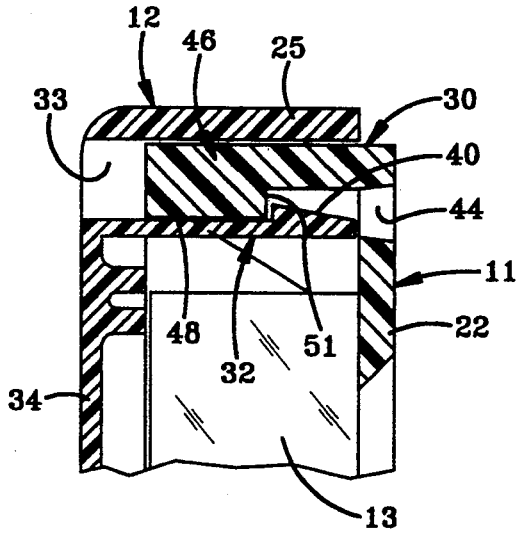
FIG. 5 is an enlarged fragmentary sectional view showing one of the locking fingers and projections in locked position.
Figure 6:
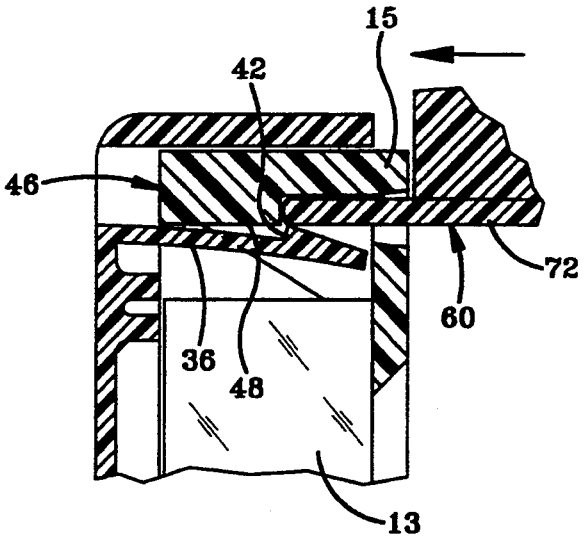
FIG. 6 is a fragmentary sectional view similar to FIG. 5, showing a release key operatively engaged with the locking mechanism of FIG. 5.
Figure 7:
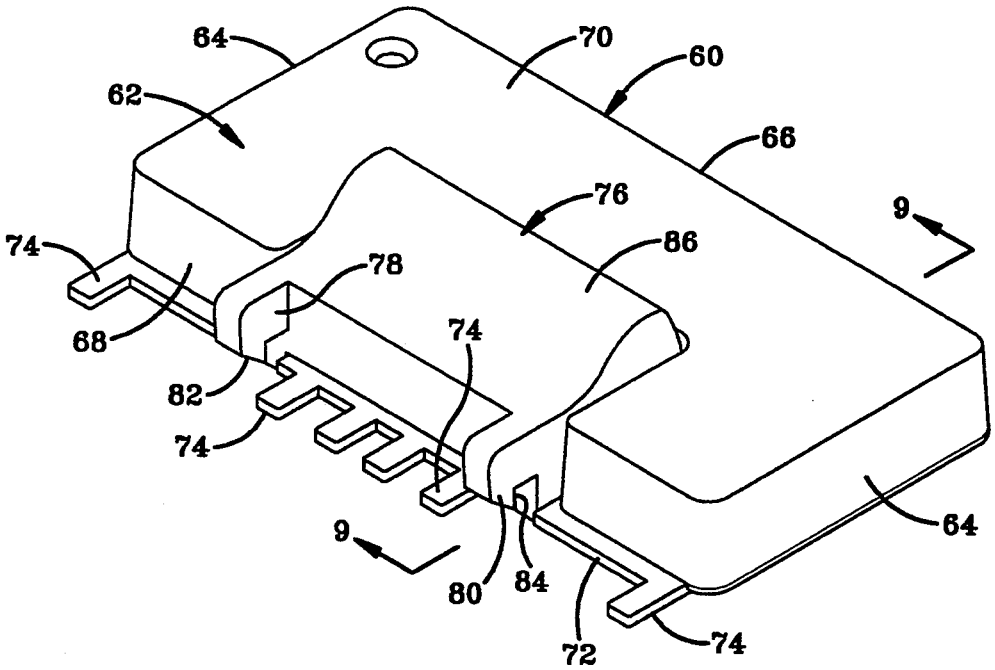
FIG. 7 is a perspective view of the improved release key of the invention.

A plurality of key receiving openings or holes 44, as shown particularly in FIGS. 4–6, are formed in bottom wall ledge 22 and align with fingers 32 (FIG. 4) when lid 12 is in the closed position. The two centermost holes 44 of the group of four center holes 44 do not align with associated fingers of lid 12. The two outer end holes 44 are located between spaced gussets 37 which serve as finger guides and containment members. A similar pair of gussets 39 are formed at the ends of the group of four center holes 44. A pair of stiffening members 41 are formed on end wall 15 between the two end pairs of key holes 44.

Referring to FIG. 4, a plurality of locking projections or pads 46, spaced to cooperate with fingers 32 of lid 12, are formed integrally with and extend from end wall 15, with one locking projection 46 cooperating with a respective one of flexible finger 32. Each lock pad 46 presents a face surface 48 which faces inwardly and a lock shoulder 51 which meets both face surface 48 and front wall 15 transversely.

The operation of locking mechanism 30 is best shown in FIGS. 5 and 6. As lid 12 is closed onto base 11, camming surfaces 40 of fingers 32 will contact face surfaces 48 of lock pads 46 and cause stems 36 to flex inwardly until shoulders 42 pass beyond lock shoulders 51 whereupon stressed fingers 32 will snap outwardly to assume the locked position shown in FIG. 5. In this position, shoulders 42 will engage lock shoulders 51 to prevent opening movement of lid 12 with respect to base 11.

Figure 9:
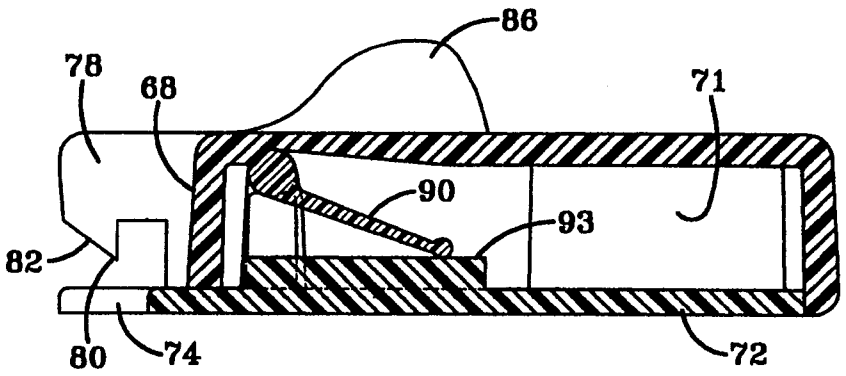
FIG. 9 is an enlarged sectional view taken on line 9—9, FIG. 7 with the key lever in an at rest position.
Figure 10:
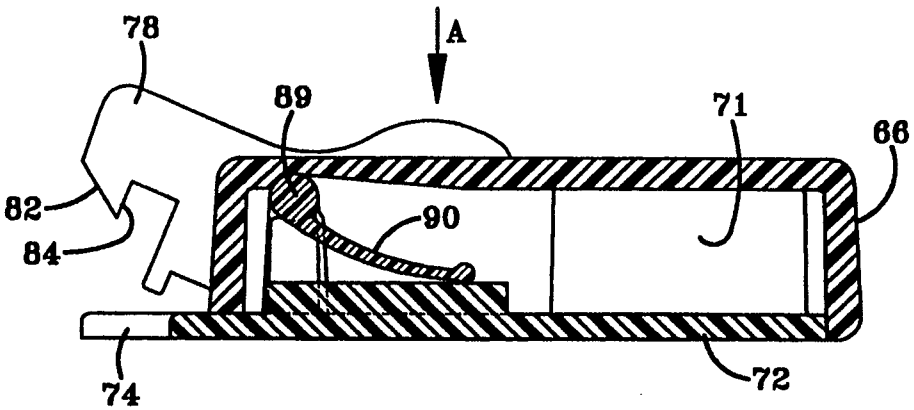
FIG. 10 is a sectional view similar to FIG. 9, with the key lever shown in the raised position.
Figure 8:
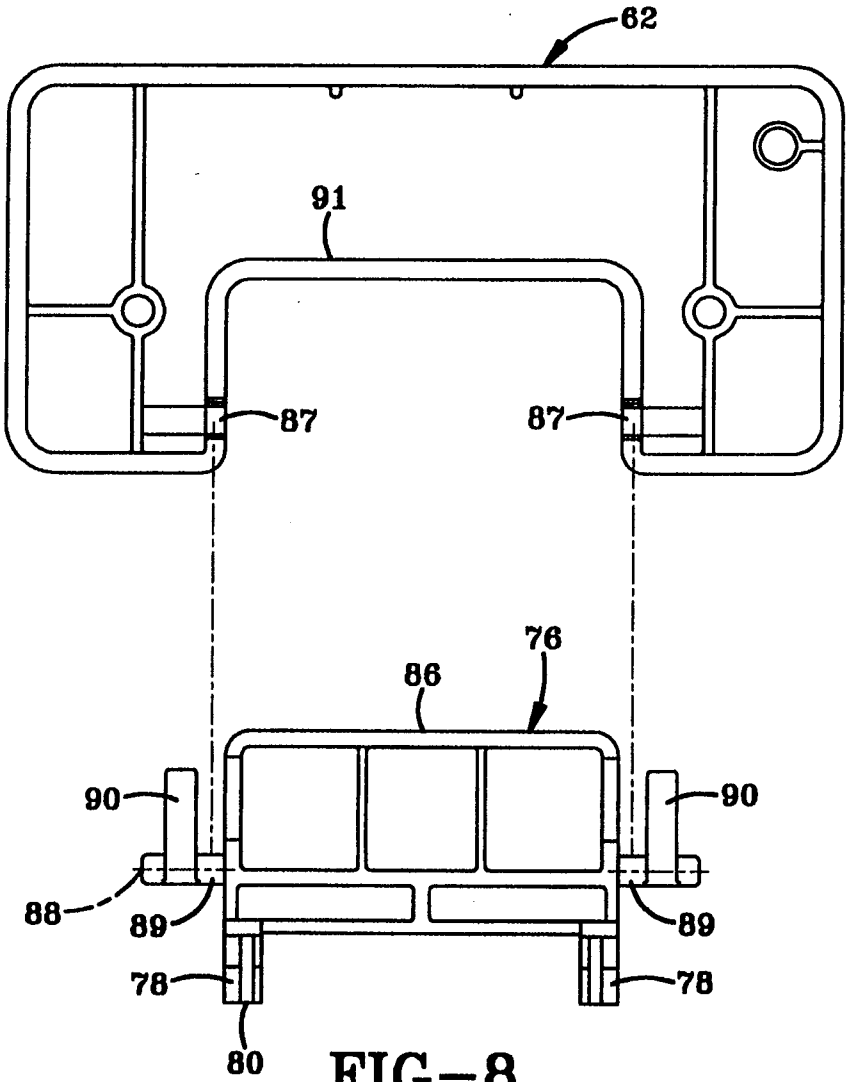
FIG. 8 is an exploded plan view of the interior of the release key housing and lever-pivot portions thereof.

To disengage flexible fingers 32 from lock pads 46 thereby unlocking lid 12, a novel release key 60 (FIGS. 7–10) is utilized. In accordance with one of the features of the invention, key 60 includes a housing indicated generally at 62, which has a rectangular configuration, and is formed by a pair of spaced parallel end walls 64, a rear wall 66, a front wall 68 and a top wall 70. A separate bottom wall 72 is removably mounted on housing 62 by screws (not shown) or other attachment members, to form a hollow interior 71 (FIGS. 9 and 10). A plurality of tabs 74 are formed integrally on bottom wall 72 and extend outwardly beyond front wall 68 and are spaced apart to complement the spacing of certain holes 44 of bottom wall ledge 22 of base 11 of the storage container. In the preferred embodiment, tabs 74 extend outwardly from the front wall 68 near the bottom of front wall 68. However, it should be understood that as long as tabs 74 align with holes 44, the locations of key tabs 74 may be altered without departing from the spirit of the present invention.

A key lever indicated generally at 76 is pivotally mounted on housing 62 as shown in FIGS. 7–10. Key lever 76 provides two grasp or gripper tangs 78 which terminate at ends 80. Extending from each end 80 is a downwardly extending cam surface 82 which joins tang 78 at a shoulder 84. A bulbous thumb or finger block 86 extends upwardly from key lever 76. Lever 76 is pivotally attached to base 62 at a pivot axis 88 by a pair of shafts 89 which rest in two spaced U-shaped slots 87 formed in a U-shaped wall 91 of housing or base 62. A pair of flexible leaf spring like members 90 are formed integrally with shaft 89 and extend outwardly therefrom with their extended ends abutting against a pair of raised ribs 93 formed on bottom wall 72. Pivot 88 is located linearly between gripper tangs 78 and thumb block 86 such that when pressure is applied along arrow A (FIG. 10), tangs 78 will be raised. Moreover, when no pressure is applied to thumb block 86, leaf springs 90 bias key lever 76 into a gripping position where tangs 78 are in their lower position as shown particularly in FIG. 9. However, when sufficient force is applied along arrow A (FIG. 10), or alternatively along cam surfaces 82, either force will pivot key lever 76 by overcoming the biasing force of springs 90, causing spring 90 to flex downwardly as shown in FIG. 10, and allow the grasping tang 78 to be raised upwardly to a release position.

Figure 11:
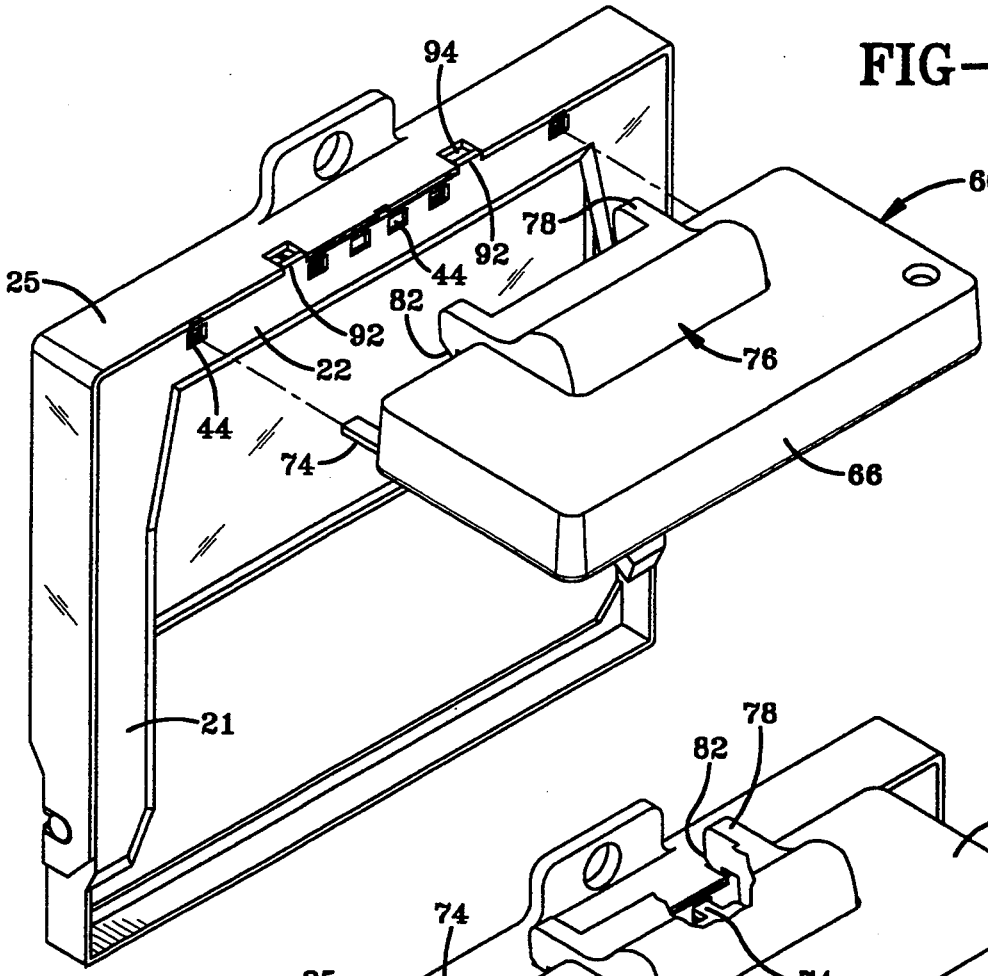
FIG. 11 is a perspective view of the security container similar to FIG. 2, just prior to the release key being inserted therein.
Figure 11A:
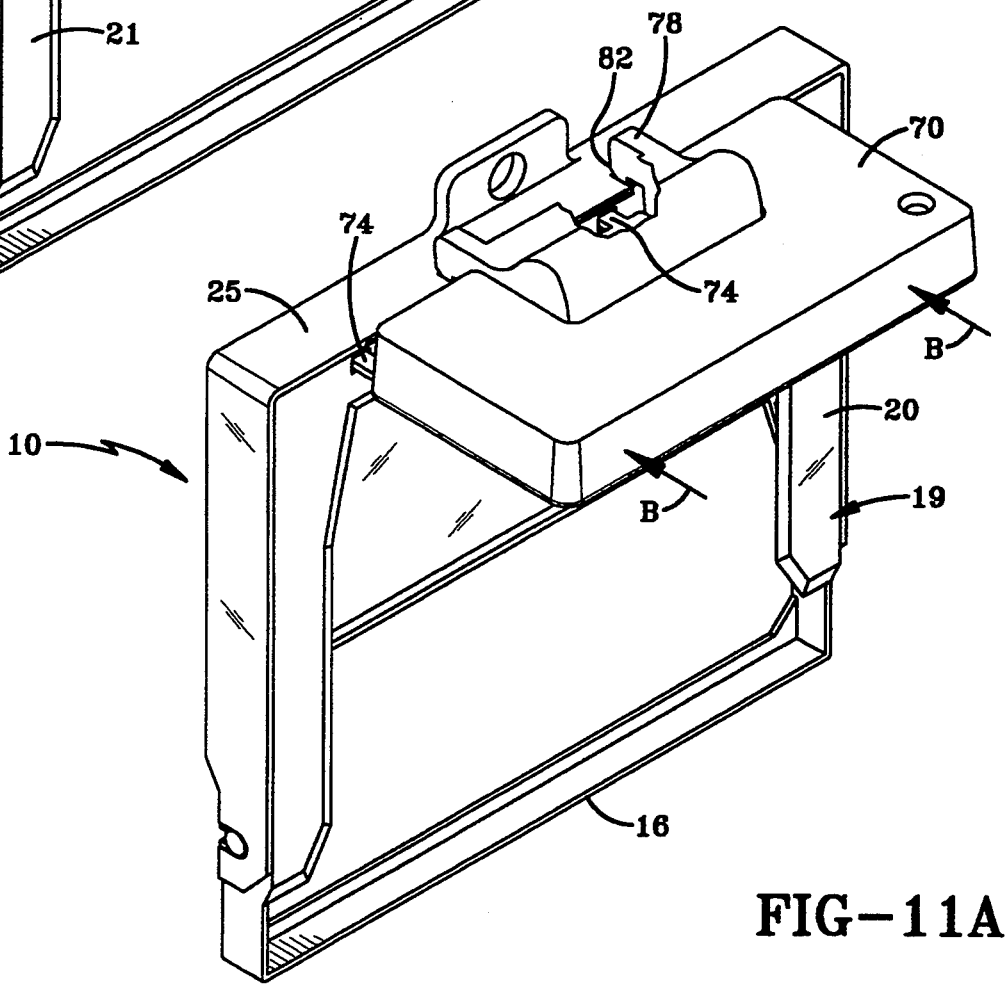
FIG. 11A is a perspective view similar to FIG. 11 with portions broken away, showing the key in engaged unlocking position with the security container.
Figure 12:
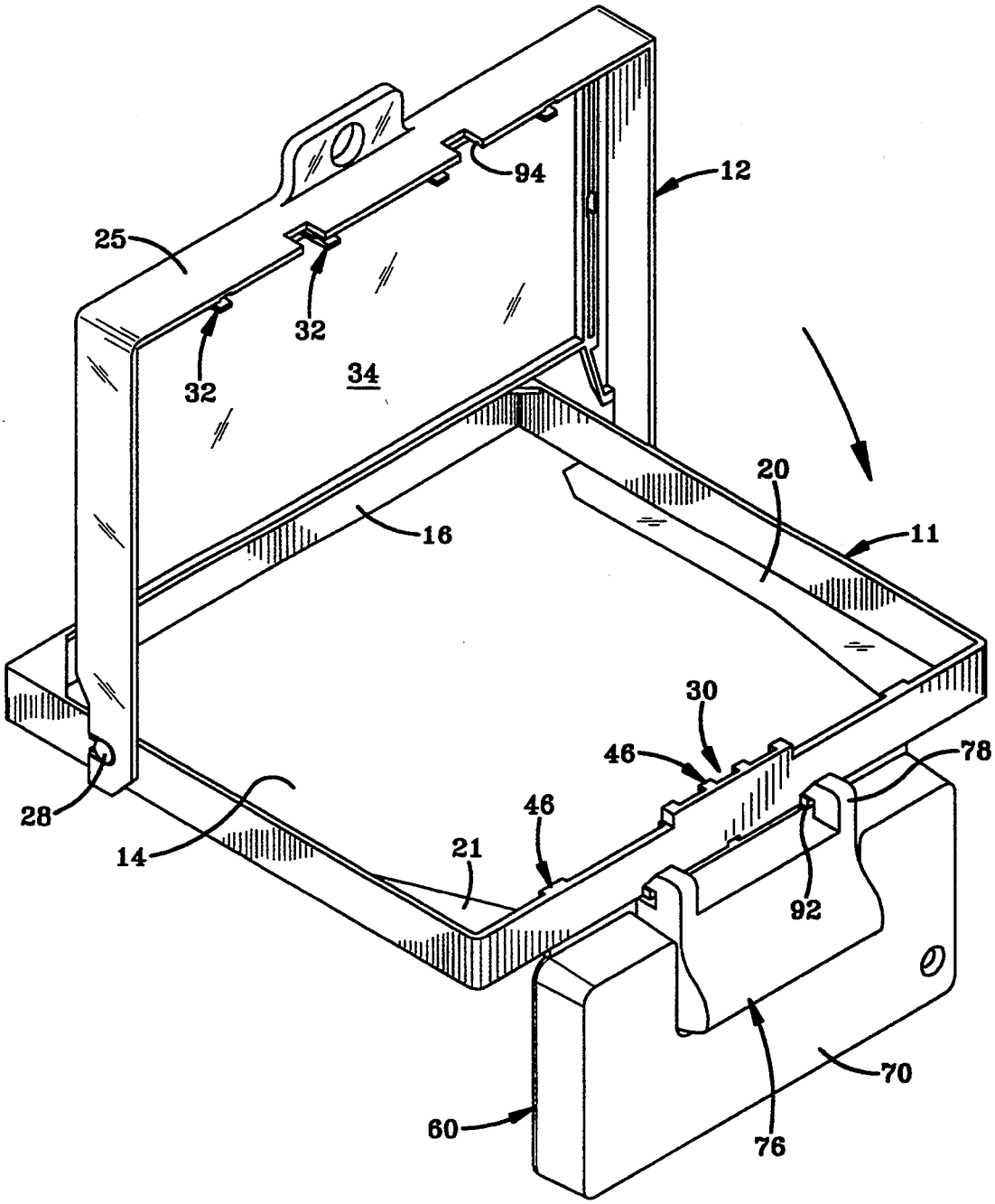
FIG. 12 is a perspective view showing the lid of the security container being moved into the unlocked position.

Referring to the general operation of key 60 in accordance with the invention, as tabs 74 are inserted through aligned holes 44 of base ledge 22, they will slide along tapered camming surfaces 40 of fingers 32 flexing the fingers inwardly such that shoulders 42 will disengage from lock shoulders 51 of lock pads 46 (FIGS. 6,11 and 11A). The disengagement at fingers 32 from lock pads 46 will permit lid 12 to be opened thereby releasing the enclosed cassette or CD from within the storage compartment.

Referring to FIGS. 11 and 11A, as key tabs 74 are inserted into holes 44 along the direction as indicated by arrows B (FIG. 11A), camming surfaces 82 of tangs 78 will slide over a pair of tabs or projections 92 which extend from the edge of ledge 22 of bottom wall 19 of base 11, by flexing biasing means 90 until shoulders 84 passes beyond tabs 92 causing key lever 76 to snap downwardly into a pair of cutouts or recesses 94 formed in lid wall 25 and assume the position shown in FIG. 11A where tangs 78 engage tabs 92.

It is noted that in this position tangs 78 are in releasable engagement with bottom wall 19 of base 11. Moreover, tabs 74 have disengaged the locking engagement of shoulders 42 and lock pad shoulders 50 as shown in FIG. 6. An outward force then is applied to key 60 in an opposite direction to that of arrows B (FIG. 11A), which moves the lid and base to an open position as shown in FIG. 1, such that an enclosed CD, cassette or other article may be removed from the storage compartment of security container 10.

An advantage of the improved security container with corresponding key 60, is that the user operated key remains in gripping contact with the security container as it is opened. As such, the key need not be released by the user to allow the user to grasp the lid with one hand and the base with the other hand which could cause the key to become disengaged from the locking means, or to entirely fall from the locking means.

Another advantage is that once release key 60 has been employed to open security container 10, releasing the key therefrom is simply a matter of applying a downward force on the bulbous thumb block 86 of key lever 76 which will cause shoulders 84 to disengage from tabs 92 of base bottom wall 19, thereby allowing key tabs 74 to be easily withdrawn from holes 44 of base 11.

FIG. 13 shows key 60 being used with a different size security container 50 of the type used for holding usual audiocassettes. Container 50 will have a lock mechanism similar to that described above with respect to container 10, and therefore is not described in further detail. However, container 50 will be of a smaller transverse configuration, that is, end wall 95 will be of a shorter length than end walls 25 and 15 of container 10. In this arrangement the two outer most tabs 74 will perform no function when inner tabs 74 are inserted through their respective key receiving holes 44 which were formed in the base of container. The two outermost tabs 74 will extend along side walls 96 of container 50. Gripping tangs 78 will grip corresponding pads formed on the base of container 50 in a similar manner described above with respect to pads 46 of container 10.

Preferably, audiocassette container 50 will have a group of four locking fingers 32 located adjacent a central recess 33 instead of only two fingers as shown particularly in FIG. 3 for container 10. These four locking fingers will be releasably unlockingly engaged by the four central tabs 74 of key 60. The remaining operation for opening container 50 is similar to that of container 10 wherein gripper tangs 78 automatically grip locking pads formed on the base of container 50 upon insertion of the unlocking tabs 74 through the aligned holes and into engagement with the flexible fingers whereupon the user merely pulls outwardly on the key while holding the lid in the other hand which will automatically move the lid and base of container 50 to an open position enabling the contents to be removed therefrom.

Thus, key 60 is adaptable for use with various size containers and locking configurations wherein for smaller containers, the outer most end key tabs 74 are inoperative with only the inner unlocking tabs 74 being utilized for unlocking a greater number of locking fingers located within a smaller area than when used with a security container having a greater width such as container 10 discussed above.

Accordingly, the cassette security container with the corresponding improved release key is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cassette security package is constructed and used, the characteristics of the construction, and the advantageous, new and useful results obtained; the new and useful structures, devices, elements, arrangements, parts and combinations, are set forth in the appended claims.

I claim:

1. A key for unlocking a lock mechanism of a security container having a base and a closure lid for holding an article; said key includes a housing; a plurality of tabs including a pair of end tabs and a group of inner tabs extending outwardly from said housing for operatively engaging and unlocking a lock mechanism of a security container; separate gripper means mounted on the housing for releasably gripping either the lid or base of the security container for moving the lid from a closed locked position toward an open position after the tab has unlocked the lock mechanism; and release means on the housing for selectively releasing the gripper means from said lid or base after the lid has been moved to an open position.

2. A key as defined in claim 1 wherein said gripper means includes a tang extending outwardly from said housing which has a tapered camming surface and a shoulder, wherein said shoulder is adapted to releasably engage either said lid or said base of said security container.

3. A key as defined in claim 2 wherein a spring is mounted within the housing and biases said tang toward a gripping position.

4. A key as defined in claim 3 wherein the release means comprises a lever and pivot means for pivotally mounting said lever on the housing; in which said lever includes a thumb block located on a first side of said pivot means, with the tang being mounted on the lever and positioned on a second side of said pivot means such that said thumb block may be depressed to overcome the bias of said spring, thereby rotating said lever about the pivot means to selectively release the tang from the lid or base.

5. A key as defined in claim 2 wherein the tab extends outwardly from the housing in the same direction as the tang.

6. A key as defined in claim 1 wherein the gripper means includes a pair of tangs, each of which is located between one of the end tabs and said group of inner tabs.

7. A key as defined in claim 4 further comprising two tangs mounted on the lever for releasably engaging either the base or lid of the security container.

8. A key as defined in claim 1 in which the housing has a hollow interior; in which the release means includes a lever having a pivot shaft located within the housing for pivotally mounting said lever thereon; in which the gripper means includes a plurality of gripping tangs mounted on the lever; and in which spring means located within the interior of the housing pivotally biases said lever and said tangs toward a gripping position.

9. A key as defined in claim 4 in which the lever, tangs and spring means are formed as an integral one piece member of molded plastic.

10. In combination, a security container having a base forming a storage compartment, a lid mounted on the base and movable between open and closed position with respect to said base, and locking means for locking said base to said lid when in the closed position; and a key for unlocking the lid from the base to enable the lid to be moved toward the open position, said key having at least one tab for operatively engaging and unlocking the lock means of the security container, separate gripper means for releasably gripping the base while the lid is being moved toward the open position, and release means for selectively releasing the gripper means from the base after the lid has been moved toward the open position.

11. The combination defined in claim 10 in which the locking means include a plurality of flexible fingers and a plurality of locking projections releasably engaged by said fingers; and in which the key includes a plurality of tabs which disengage the flexible fingers from locking engagement with the projections to unlock the lid from the base.

12. The combination defined in claim 11 in which the key includes a housing with the tabs extending outwardly therefrom; in which the release means includes a lever pivotally mounted on the housing and moveable between a gripping position and a release position; and in which the gripper means includes a plurality of gripping tangs mounted on the lever for releasably gripping the base of the security container.

13. The combination defined in claim 12 in which the gripper means further includes spring means for biasing the gripping tangs toward the gripping position.

14. The combination defined in claim 13 in which the security container base has at least one projection formed thereon which is releasably engaged by one of the gripping tangs; and in which the lid is formed with at least one recess adapted to receive the said one projection when the lid is in the closed position.

15. The combination defined in claim 11 in which the base is formed with a plurality of key receiving holes aligned with the flexible finger and locking projections; and in which the tabs extend through said holes for disengaging the fingers from the projections.

16. The combination defined in claim 11 in which the security container has an outer end pair of fingers and a plurality of spaced inner fingers; and in which the end fingers are spaced a greater distance from the inner fingers than the distance that the inner fingers are spaced apart from each other.

17. The combination defined in claim 16 in which the tabs include a pair of outer end-tabs and a group of inner tabs; in which the inner tabs engage the locking means to disengage the flexible fingers from locking engagement with the projections; and in which the outer end tabs have a sufficiently wide spacing so as to be free of engagement with the security container when the inner tab engages the locking means.

18. The combination defined in claim 14 in which at least one of the gripping tangs has a camming surface for slidably engaging the projections formed on the base for moving the said one gripping tang towards a gripping position with said projection; and in which said one gripping tang has a shoulder for engaging the projection to enable said one gripping tang to releasably grip the base.

* * * * *